US012698179B2

(12) United States Patent
Daoust et al.

(10) Patent No.: US 12,698,179 B2
(45) Date of Patent: Aug. 4, 2026

(54) CABLE REEL CONFIGURED TO ABSORB FORCES IMPACTING A PERIMETER WALL OF THE REEL TO PREVENT BREAKAGE

(71) Applicant: PPC BROADBAND, INC., East Syracuse, NY (US)

(72) Inventors: Daniel Daoust, Syracuse, NY (US); Amos McKinnon, Liverpool, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 140 days.

(21) Appl. No.: 18/440,854

(22) Filed: Feb. 13, 2024

(65) Prior Publication Data

US 2024/0270536 A1 Aug. 15, 2024

Related U.S. Application Data

(60) Provisional application No. 63/445,295, filed on Feb. 13, 2023.

(51) Int. Cl.
*B65H 75/14* (2006.01)
*B65H 75/12* (2006.01)
*B65H 75/22* (2006.01)

(52) U.S. Cl.
CPC ..... *B65H 75/145* (2013.01); *B65H 75/2245* (2021.05); *B65H 75/12* (2013.01)

(58) Field of Classification Search
CPC .. B65H 75/145; B65H 75/22; B65H 75/2245; B65H 75/2272

(Continued)

(56) References Cited

U.S. PATENT DOCUMENTS 3,201,059 A 8/1965 Winkel
3,591,104 A * 7/1971 Hafner ..... B65H 75/145 242/604

(Continued)

FOREIGN PATENT DOCUMENTS

EP 0685410 A1 12/1995
FR 1399574 A 5/1965

(Continued)

OTHER PUBLICATIONS

International Search Report and Written Opinion dated Jun. 13, 2024 in corresponding International Application No. PCT/US2024/015637, 16 pages.

(Continued)

*Primary Examiner* — Anna M Momper
*Assistant Examiner* — Tiffany Domonique Jefferson
(74) *Attorney, Agent, or Firm* — MH2 TECHNOLOGY LAW GROUP LLP

(57) ABSTRACT

A cable reel may include a first reel portion configured to hold a bundle of cable, and a second reel portion configured to be coupled with the first reel portion and to retain the bundle of cable on the first reel portion. The second reel portion may include a first impact portion radially outward of a hub portion and a second impact portion radially outward of the first impact portion between the first impact portion and a perimeter wall of the flange portion. The second impact portion may include a radially outer wall that is configured to deflect radially inward to absorb an impact force impacting the perimeter wall at a location radially aligned with the second impact portion, and the first impact portion may include a radially outer wall that is configured to deflect radially inward to absorb an impact force impacting the perimeter wall at a location circumferentially spaced from the radially outer wall. The first and second impact (Continued)

portions may be configured to provide absorption of impact forces impinging on any point along the perimeter wall so as to provide 360° of breakage protection against impact forces impinging on the perimeter wall.

24 Claims, 3 Drawing Sheets

(58) Field of Classification Search
USPC ..... 242/608.4, 614.1, 609.3
See application file for complete search history.

(56) References Cited

U.S. PATENT DOCUMENTS

| | | | | |
|---|---|---|---|---|
| D290,340 | S | 6/1987 | McCaffrey | |
| 4,883,178 | A * | 11/1989 | Thiele | B65D 85/04 206/415 |
| D334,334 | S | 3/1993 | Jarry | |
| D359,440 | S | 6/1995 | Stewart | |
| D379,425 | S | 5/1997 | Wright et al. | |
| D408,720 | S | 4/1999 | Sheng | |
| D422,197 | S | 4/2000 | Kovacik et al. | |
| D432,396 | S | 10/2000 | Barthel | |
| D478,498 | S | 8/2003 | Ito et al. | |
| D518,361 | S | 4/2006 | Jassenoff | |
| D557,118 | S | 12/2007 | Linginfelter | |
| D582,754 | S | 12/2008 | Stein | |
| D582,755 | S | 12/2008 | Rogers et al. | |
| D598,733 | S | 8/2009 | Taatjes et al. | |
| D636,253 | S | 4/2011 | Hatcher et al. | |
| 8,328,127 | B2 | 12/2012 | Ito et al. | |
| D787,919 | S | 5/2017 | Knight | |
| D957,233 | S | 7/2022 | Yui | |
| 11,560,287 | B2 * | 1/2023 | Matari | B65H 75/2416 |
| 2015/0329311 | A1 * | 11/2015 | Connell | B65H 75/14 242/118.61 |
| 2022/0098002 | A1 | 3/2022 | Kisselstein et al. | |

FOREIGN PATENT DOCUMENTS

| | | | |
|---|---|---|---|
| JP | 2022023527 | A | 2/2022 |
| KR | 20120133491 | A | 12/2012 |
| KR | 20220168467 | A | 12/2022 |

OTHER PUBLICATIONS

"Fluke Cable Reel 25M GR Ground/Earth Cable Reel 25 m (81.25 ft)," posted Jun. 24, 2024 [online], [retrieved Jun. 24, 2024]. Retrieved from internet: <URL: https://www.tequipment.net/Fluke/CABLE-REEL- 25M-GR/General-Accessories/?Source=googleshopping&gad_source=1&gclid=Cj0KCQjwsuSzBhCLARIsAlcdLm7fZBpXC-F443S98JGM57QsSFOH2o8PZqBqREH51ZFhMjltULG41aQaApfcEALw_wcB >.

* cited by examiner

CABLE REEL CONFIGURED TO ABSORB FORCES IMPACTING A PERIMETER WALL OF THE REEL TO PREVENT BREAKAGE

CROSS-REFERENCE TO RELATED APPLICATION

This application claims the benefit of U.S. Provisional Patent Application No. 63/445,295, filed Feb. 13, 2023, the contents of which are incorporated herein by reference.

TECHNICAL FIELD

The present disclosure relates to a cable reel and, more particularly, to a reusable reel for storing and dispensing cable, wire, and the like.

BACKGROUND

Conventionally, various types of cable, wire, and the like are wound onto reels for storage, shipping, and field use. Typical reels are constructed of wood or plastic that can withstand the stresses of storage and shipping. The weight of the reels adds to the cost of transportation of the cable, wire, or the like that is held on the reel, which increases the cost that must be paid for by the customer or vendor. After the reels are emptied, typically, the reels are then thrown away because the cost of returning them to the supplier for reuse is too high.

Some conventional reels have been designed to be reusable. For example, a reusable reel may include one or two flanges that are detachably coupled with a spindle. Such a reusable reel accepts spools (i.e., reel-less bundles) of cable, and after the cable is fully paid out from the reel, one of the flanges is detached from the spindle to allow for loading another spool of cable in the field. To reduce the weight of such a reusable reel, the reel may be constructed of a plastic material or a composite. However, when a plastic reel is dropped and one or both of the flanges hits the ground or another solid surface, the flange or flanges often crack, thereby rendering the reel usable and defeating the purpose of the reusable reel.

Therefore, it may be desirable to provide a reusable reel that is configured to absorb the shock of impact forces when dropped on the ground or other solid surface so as to prevent the reusable reel from breaking. It may be desirable to provide a reusable reel that is relatively light in weight in order to reduce transportation costs. It may be desirable to provide a reusable reel that can be made relatively inexpensively.

SUMMARY

According to an exemplary embodiment of the disclosure, a cable reel configured to absorb forces impacting a perimeter wall of the reel to prevent breakage may include a spindle portion configured to hold a bundle of cable, a flange portion configured to retain the bundle of cable on the spindle portion, and a coupling portion configured to couple the flange portion with an end of the spindle portion. The flange portion may include a hub portion having a through hole configured to receive a connection portion of the spindle portion and an insert portion of the coupling portion, the insert portion of the coupling portion may be configured to be threadedly coupled with the connection portion of the spindle portion, and the flange portion may include a first impact portion radially outward of the hub portion and a second impact portion radially outward of the first impact portion between the first impact portion and a perimeter wall of the flange portion. The first impact portion may include a circumferential arrangement of inner openings spaced apart in a circumferential direction, the second impact portion may include a circumferential arrangement of outer openings spaced apart in a circumferential direction, and the flange portion may include an impact transfer portion between each pair of adjacent ones of the outer openings. A radially outer wall of each outer opening may be configured to deflect radially inward to absorb an impact force impacting the perimeter wall at a location where the outer opening does not overlap one of the inner openings, and the impact transfer portion between adjacent ones of the outer openings may be configured to transfer an impact force impacting the perimeter wall at a location where one of the inner openings is not overlapped by one of the outer openings to the one of the inner openings, and a radially outer wall of the one of the inner openings is configured to deflect radially inward to absorb the impact force. A radially outer wall of one of the outer openings and a radially outer wall of one of the inner openings may be configured to deflect radially inward to absorb an impact force that impinges on the perimeter wall at a location where the one of the outer openings overlaps the one of the inner openings, and the first and second impact portions may be configured to provide absorption of impact forces impinging on any point along the perimeter wall so as to provide 360° of breakage protection against impact forces impinging on the perimeter wall.

In some aspects of the aforementioned cable reel, the flange portion may include a first flange portion and a second flange portion that are identical to one another.

In some aspects of the aforementioned cable reel the first flange portion and the second flange portion may be configured to be aligned with one another in a first direction.

In some aspects of the aforementioned cable reel, the first flange portion and the second flange portion may be configured to rotate together when cable is being paid out from a reel-less bundle of cable mounted on the spindle portion.

In some aspects of the aforementioned cable reel, the inner openings may comprise oblong openings, and the outer openings may comprise oblong openings.

In some aspects, the aforementioned cable reel may further comprise a strengthening portion structurally configured to prevent radially inward deflection of radially inner walls of the inner openings in response to an impact force against the perimeter wall.

In some aspects, the aforementioned cable reel may further comprise a strengthening portion structurally configured to prevent radially inward deflection of radially inner walls of the outer openings in response to an impact force against the perimeter wall.

According to an exemplary embodiment of the disclosure, a cable reel configured to absorb forces impacting a perimeter wall of the reel to prevent breakage may include a spindle portion configured to hold a bundle of cable and a flange portion configured to be coupled with the spindle portion and to retain the bundle of cable on the spindle portion. The flange portion may include a first impact portion radially outward of a hub portion and a second impact portion radially outward of the first impact portion between the first impact portion and a perimeter wall of the flange portion. The first impact portion may include a circumferential arrangement of inner openings spaced apart in a circumferential direction, the second impact portion may include a circumferential arrangement of outer openings spaced apart in a circumferential direction, and the flange portion may include an impact transfer portion between a pair of adjacent ones of the outer openings. A radially outer wall of an outer opening of the plurality of outer openings may be configured to deflect radially inward to absorb an impact force impacting the perimeter wall at a location radially outward of and radially aligned with the outer opening, and the impact transfer portion between a pair of adjacent ones of the outer openings may be configured to transfer an impact force impacting the perimeter wall at a location radially outward of and radially aligned with a space between the pair of adjacent ones of the plurality of outer openings to one of the inner openings radially aligned with the space, and a radially outer wall of the one of the inner openings may be configured to deflect radially inward to absorb the impact force. The first and second impact portions may be configured to provide absorption of impact forces impinging on any point along the perimeter wall so as to provide 360° of breakage protection against impact forces impinging on the perimeter wall.

In some aspects of the aforementioned cable reel, the flange portion may include a first flange portion and a second flange portion that are identical to one another.

In some aspects of the aforementioned cable reel the first flange portion and the second flange portion may be configured to be aligned with one another in a first direction.

In some aspects of the aforementioned cable reel, the first flange portion and the second flange portion may be configured to rotate together when cable is being paid out from a reel-less bundle of cable mounted on the spindle portion.

In some aspects of the aforementioned cable reel, the inner openings may comprise oblong openings, and the outer openings may comprise oblong openings.

In some aspects, the aforementioned cable reel may further comprise a strengthening portion structurally configured to prevent radially inward deflection of radially inner walls of the inner openings in response to an impact force against the perimeter wall.

In some aspects, the aforementioned cable reel may further comprise a strengthening portion structurally configured to prevent radially inward deflection of radially inner walls of the outer openings in response to an impact force against the perimeter wall.

In some aspects of the aforementioned cable reel, a radially outer wall of one of the outer openings and a radially outer wall of one of the inner openings may be configured to deflect radially inward to absorb an impact force that impinges on the perimeter wall at a location where the one of the outer openings overlaps the one of the inner openings.

According to an exemplary embodiment of the disclosure, a cable reel configured to absorb forces impacting a perimeter wall of the reel to prevent breakage may include a first reel portion configured to hold a bundle of cable and a second reel portion configured to be coupled with the first reel portion and to retain the bundle of cable on the first reel portion. The second reel portion may include a first impact portion radially outward of a hub portion and a second impact portion radially outward of the first impact portion between the first impact portion and a perimeter wall of the flange portion. The second impact portion may include a radially outer wall that is configured to deflect radially inward to absorb an impact force impacting the perimeter wall at a location radially aligned with the second impact portion, and the first impact portion may include a radially outer wall that is configured to deflect radially inward to absorb an impact force impacting the perimeter wall at a location circumferentially spaced from the radially outer wall. The first and second impact portions may be configured to provide absorption of impact forces impinging on any point along the perimeter wall so as to provide 360° of breakage protection against impact forces impinging on the perimeter wall.

In some aspects of the aforementioned cable reel, the flange portion may include a first flange portion and a second flange portion that are identical to one another.

In some aspects of the aforementioned cable reel the first flange portion and the second flange portion may be configured to be aligned with one another in a first direction.

In some aspects of the aforementioned cable reel, the first flange portion and the second flange portion may be configured to rotate together when cable is being paid out from a reel-less bundle of cable mounted on the spindle portion.

In some aspects of the aforementioned cable reel, the first impact portion includes a circumferential arrangement of inner openings spaced apart in a circumferential direction, the second impact portion includes a circumferential arrangement of outer openings spaced apart in a circumferential direction, and the flange portion may include an impact transfer portion between each pair of adjacent ones of the outer openings. A radially outer wall of each outer opening may be configured to deflect radially inward to absorb an impact force impacting the perimeter wall at a location where the outer opening does not overlap one of the inner openings, and the impact transfer portion between adjacent ones of the outer openings may be configured to transfer an impact force impacting the perimeter wall at a location where one of the inner openings is not overlapped by one of the outer openings to the one of the inner openings.

In some aspects of the aforementioned cable reel, the inner openings may comprise oblong openings, and the outer openings may comprise oblong openings.

In some aspects, the aforementioned cable reel may further comprise a strengthening portion structurally configured to prevent radially inward deflection of radially inner walls of the inner openings in response to an impact force against the perimeter wall.

In some aspects, the aforementioned cable reel may further comprise a strengthening portion structurally configured to prevent radially inward deflection of radially inner walls of the outer openings in response to an impact force against the perimeter wall.

In some aspects of the aforementioned cable reel, a radially outer wall of one of the outer openings and a radially outer wall of one of the inner openings may be configured to deflect radially inward to absorb an impact force that impinges on the perimeter wall at a location where the one of the outer openings overlaps the one of the inner openings.

The foregoing and other features of construction and operation of the invention will be more readily understood and fully appreciated from the following detailed disclosure, taken in conjunction with accompanying drawings.

DETAILED DESCRIPTION OF EMBODIMENTS

As a preface to the detailed description, it should be noted that, as used in this specification and the appended claims, the singular forms "a," "an," and "the" include plural referents, unless the context clearly dictates otherwise.

Figure 1:
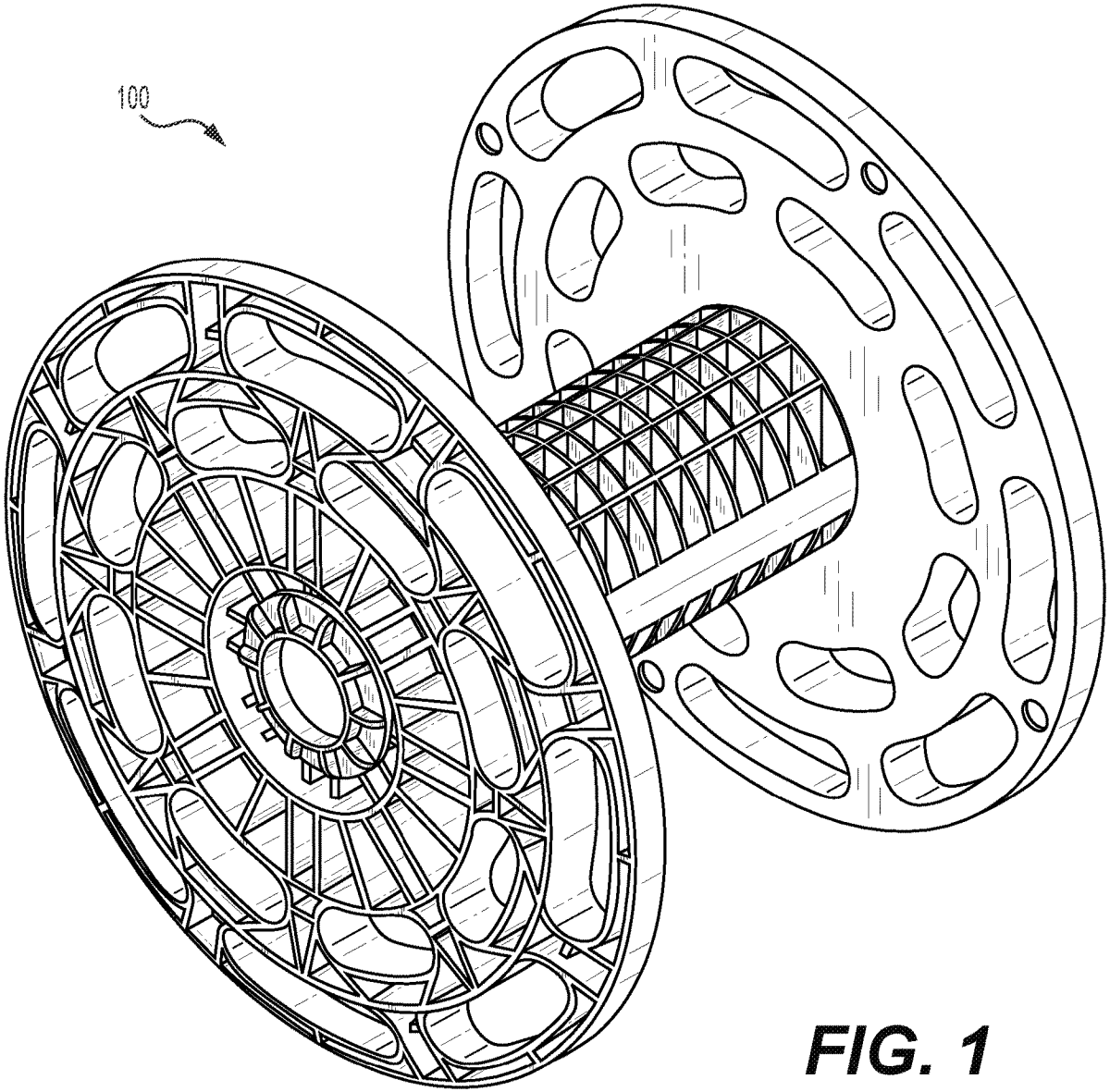
FIG. 1 is a perspective view of an exemplary reusable cable reel in accordance with various aspects of the disclosure.
Figure 2:
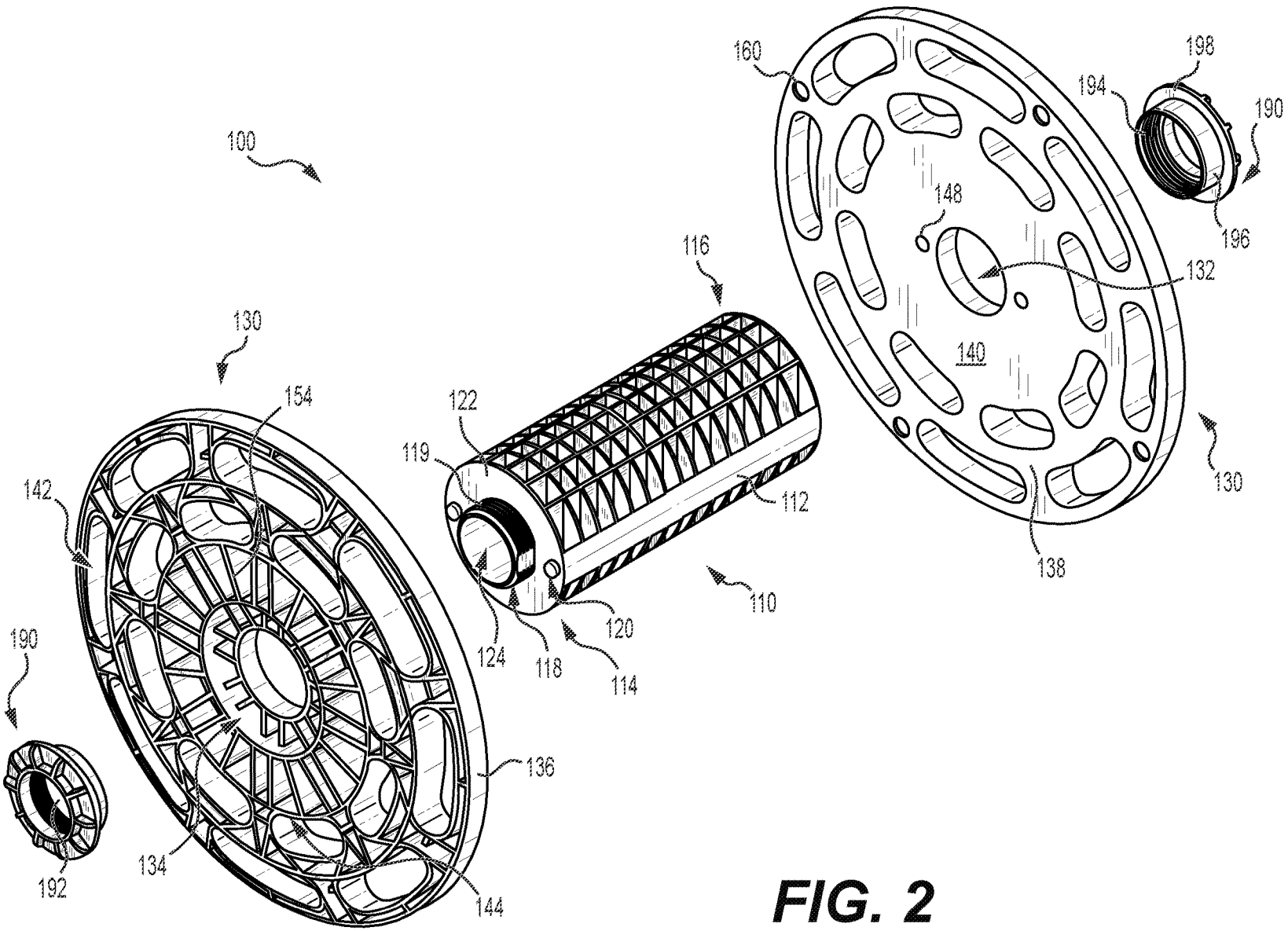
FIG. 2 an exploded perspective view of the reusable cable reel of FIG. 1.
Figure 3:
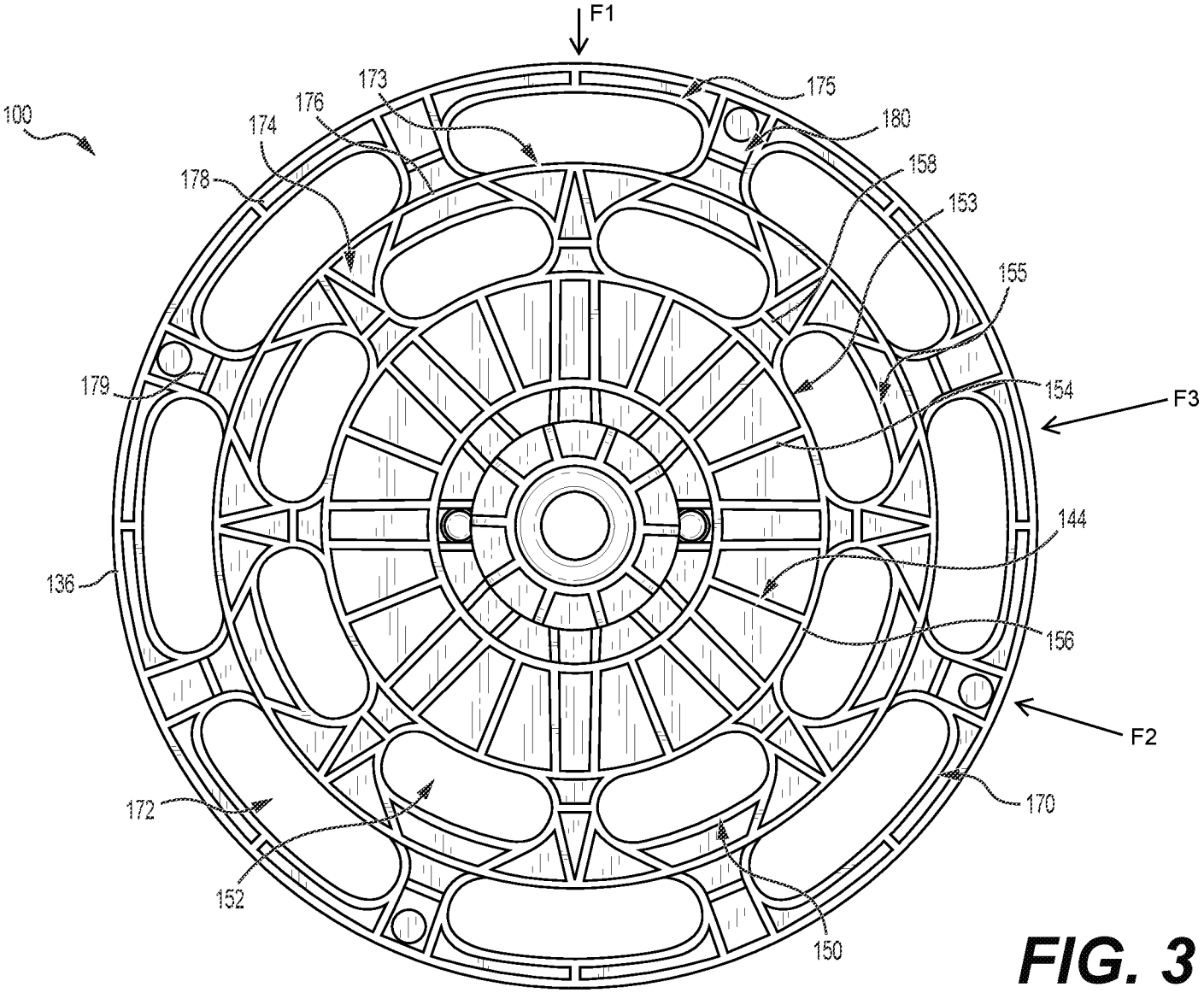
FIG. 3 is a front view of the flange portion of the reusable cable reel of FIG. 1.

Referring to FIGS. 1-3, an exemplary cable reel 100, for example, a reusable cable reel, in accordance with various aspects of the disclosure is illustrated and described. The reusable reel 100 includes a first reel portion or cable holding portion 110, for example, a spindle or spindle portion, and a second reel portion or cable retaining portion 130, for example, flanges or flange portions. In the illustrated embodiment, the flange portions 130 are identical to one another, but it should be appreciated that the flange portions 130 may be different from one another in other embodiments. The reusable reel 100 may include a coupling portion or coupling member 190, for example, end caps, that are configured to couple the flange portions 130 with the spindle portion, as described in more detail below.

The spindle portion 110 may comprise a generally cylindrical elongated portion 112 having a first end 114 and a second end 116. The spindle portion 110 may include a connection portion 118 and an alignment portion 120 extending from a first end wall 122 at the first end 114. The connection portion 118 may be centrally disposed on the first end wall 122 and configured to be coupled with the coupling member 190. For example, in some aspects, the coupling member 190 may be configured to be removably coupled with the connection portion 118. In some aspects, the connection portion 118 may include a threaded portion 119, for example, an externally threaded portion, configured to threadedly receive an internally threaded coupling member 190. In some aspects, the threaded portion 119 may comprise an internally threaded portion or any other structure capable of being fixedly coupled with the coupling member 190 to secure the flange portion 130 to the spindle portion 110.

The spindle portion 110 includes a through bore 124 extending through the cylindrical elongated portion 112 and the connection portion 118. The through bore 124 is centrally located when the spindle portion 110 is viewed from the first end 114 and the second end 116 and is configured to receive a holding member (not shown), for example, a rod about which the spindle portion 110 can be rotated. The spindle portion 110 may be configured to hold a spool with cable wound thereon or a spool-less bundle of cable.

In some aspects, the alignment portion 120 may comprise a projection or a plurality of projections extending from the first end wall 122 radially outward of the connection portion 118. For example, as illustrated in FIG. 2, the alignment portion 120 may include two projections diametrically opposed to one another. However, it should be appreciated that any desired arrangement of the alignment portion 120 can be implemented to provide a desired predetermined orientation between the spindle portion 110 and the flange portion 130. Although not illustrated, the second end 116 of the spindle portion 110 may include a connection portion and an alignment portion that are identical to those at the first end 114.

Each of the flange portions 130 includes a center through hole 132, a hub portion 134 surrounding the through hole 132, and a perimeter wall 136. The flange portion 130 includes a first side surface 138 comprising a substantially planar wall 140 and a second side surface 142 that includes a strengthening portion 144 that extends perpendicular from the planar wall 140 of the first side surface 138. The flange portion 130 includes a first impact portion 150, for example, an impact absorption feature, and a second impact portion 170, for example, an impact absorption feature.

The first impact portion 150 comprises circumferentially arranged openings 152, for example, oblong openings, that extend through the planar wall 140 and are spaced apart from one another in the circumferential direction. The first impact portion 150 is disposed radially outward of the hub portion 134. The strengthening portion 144 may include a first strengthening portion 154, for example, a gusset, extending from the hub portion 134 toward the first impact portion 150 and a second strengthening portion 156, for example, a circular strengthening structure, adjacent inner walls 153 of the openings 152 of the first impact portion. The first and second strengthening portions 154, 156 may prevent radially inward deflection of the inner walls 153 of the openings 152 in response to an impact force against the perimeter wall 136. The strengthening portion 144 may include a third strengthening portion 158, for example, a gusset, disposed between each pair of adjacent openings 152 in the circumferential direction and extending from one of the pair of adjacent openings 152 to the other one of the pair of adjacent openings 152.

The second impact portion 170 comprises circumferentially arranged openings 172, for example, oblong openings, that extend through the planar wall 140 and are spaced apart from one another in the circumferential direction. The second impact portion 170 is disposed radially outward of the first impact portion 150 between the first impact portion 150 and the perimeter wall 136 in the radial direction.

The strengthening portion 144 may include a fourth strengthening portion 174 disposed between each pair of adjacent openings 152 in the circumferential direction and disposed between the first impact portion 150 and the second impact portion 170 in the radial direction and a fifth strengthening portion 176, for example, a circular strengthening structure, adjacent inner walls 173 of the openings 172 of the second impact portion 170. The fourth and fifth strengthening portions 174, 176 may prevent radially inward deflection of the inner walls 173 of the openings 172 in response to an impact force against the perimeter wall 136. The strengthening portion 144 may include a sixth strengthening portion 178 that extends radially outward from an outer wall 175 of the openings 172 to the perimeter wall 136 and a seventh strengthening portion 179 disposed between each pair of adjacent openings 172 in the circumferential direction.

The flange portion 130 includes an impact transfer portion 180 that extends radially inward from the perimeter wall 136 between each pair of adjacent openings 172 and to the openings 152. The circumferential arrangement of the openings 172 of the second impact portion 170 and the circumferential arrangement of the openings 152 of the first impact portion 150 are offset from one another such that a center of each of the openings 172 is aligned with a space between adjacent ones of the openings 152, and a center of each of the openings 152 is aligned with a space between adjacent ones of the openings 172.

The coupling member 190 may include a through bore 192 having an internally threaded portion 194 configured to be threaded coupled with the threaded portion 119 of the connection portion 118. In some aspects, the threaded portion 194 may comprise an externally threaded portion or any other structure capable of being fixedly coupled with the connection portion 118 to secure the flange portion 130 to the spindle portion 110. The through bore 192 is aligned with the through bore 124 of the spindle portion 110. The coupling member 190 includes an insert portion 196 sized to be inserted through the through hole 132 of the hub portion of the flange portion 130 and a shoulder portion 198 that is sized to bear against the hub portion 134 when securing the flange portion 130 to the spindle portion 110.

As shown in FIG. 3, the flange portion 130 may include an alignment portion 148 configured to be coupled with alignment portion 120 to provide a desired predetermined alignment between the flange portion 130 and the spindle portion 110. For example, the alignment portion 148 may comprise a hole or notch configured to receive an alignment portion 120 configured as a protrusion. The flange portion 130 may include a retaining portion 160, for example, a through hole, configured to retain a free end of a cable stored on the reel during nonuse in order to prevent unraveling of the cable.

In use, if the reel 100 is dropped on a firm ground or other surface, the flange portion 130 is configured to absorb forces impacting the perimeter wall 136 to prevent breakage of the flange portion 130. For example, if an impact force F1 impinges on the perimeter wall 136 at a location at or proximate to a center of one of the openings 172 (i.e., where the opening 172 does not overlap with an opening 152), the force is transferred to the opening 172 via the sixth strengthening portion 178, and the force F1 is absorbed by the opening 172 as an outer wall 175 of the opening 172 is structurally configured to deflect radially inward. If an impact force F2 impinges on the perimeter wall 136 at a location at or proximate to a midpoint between a pair of adjacent openings 172 (i.e., where opening 152 is not overlapped by an opening 172), the force is transferred to an opening 152 of the first impact portion 150 via the impact transfer portion 180, and the force F2 is absorbed by the opening 152 as an outer wall 155 of the opening 152 is structurally configured to deflect radially inward. If an impact force F3 impinges on the perimeter wall 136 at a location where one of the openings 172 overlaps one of the openings 152, the impact force is absorbed by the opening 172 as the outer wall 175 is structurally configured to deflect radially inward and by the opening 152 as the outer wall 155 is structurally configured to deflect radially inward.

As a result, the flange portion 130 includes first and second impact portions 150, 170 that are configured to provide absorption of impact forces impinging on any point along the perimeter wall 136. Thus, the flange portion 130 has 360° of breakage protection against impact forces impinging on the perimeter wall.

It should be understood that the spindle portion 110, the flange portions 130, and/or the coupling portion may comprise any moldable plastic such as, for example, polypropylene, acrylonitrile butadiene styrene (abs), nylon, polycarbonate, or the like. It should be understood that the first and second openings 152, 172 may provide handle portions for gripping by a user to facilitate lifting and/or carrying of the reel 100.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A cable reel configured to absorb forces impacting a perimeter wall of the reel to prevent breakage, comprising:

a spindle portion configured to hold a bundle of cable;

a flange portion configured to retain the bundle of cable on the spindle portion;

a coupling portion configured to couple the flange portion with an end of the spindle portion;

wherein the flange portion includes a hub portion having a through hole configured to receive a connection portion of the spindle portion and an insert portion of the coupling portion;

wherein the insert portion of the coupling portion is configured to be threadedly coupled with the connection portion of the spindle portion;

wherein the flange portion includes a first impact portion radially outward of the hub portion and a second impact portion radially outward of the first impact portion between the first impact portion and a perimeter wall of the flange portion;

wherein the first impact portion includes a circumferential arrangement of inner openings spaced apart in a circumferential direction;

wherein the second impact portion includes a circumferential arrangement of outer openings spaced apart in a circumferential direction;

wherein the flange portion include an impact transfer portion between each pair of adjacent ones of the outer openings;

wherein a radially outer wall of each outer opening is configured to deflect radially inward to absorb an impact force impacting the perimeter wall at a location where the outer opening does not overlap one of the inner openings;

wherein the impact transfer portion between adjacent ones of the outer openings is configured to transfer an impact force impacting the perimeter wall at a location where one of the inner openings is not overlapped by one of the outer openings to the one of the inner openings, and a radially outer wall of the one of the inner openings is configured to deflect radially inward to absorb the impact force;

wherein a radially outer wall of one of the outer openings and a radially outer wall of one of the inner openings are configured to deflect radially inward to absorb an impact force that impinges on the perimeter wall at a location where the one of the outer openings overlaps the one of the inner openings; and wherein the first and second impact portions are configured to provide absorption of impact forces impinging on any point along the perimeter wall so as to provide 360° of breakage protection against impact forces impinging on the perimeter wall.

2. The cable reel of claim 1, wherein the flange portion includes a first flange portion and a second flange portion that are identical to one another.

3. The cable reel of claim 2, wherein the first flange portion and the second flange portion are configured to be aligned with one another in a first direction.

4. The cable reel of claim 2, wherein the first flange portion and the second flange portion are configured to rotate together when cable is being paid out from a reel-less bundle of cable mounted on the spindle portion.

5. The cable reel of claim 1, wherein the inner openings comprise oblong openings, and wherein the outer openings comprise oblong openings.

6. The cable reel of claim 1, further comprising a strengthening portion structurally configured to prevent radially inward deflection of radially inner walls of the inner openings in response to an impact force against the perimeter wall.

7. The cable reel of claim 1, further comprising a strengthening portion structurally configured to prevent radially inward deflection of radially inner walls of the outer openings in response to an impact force against the perimeter wall.

8. A cable reel configured to absorb forces impacting a perimeter wall of the reel to prevent breakage, comprising:

a spindle portion configured to hold a bundle of cable;

a flange portion configured to be coupled with the spindle portion and to retain the bundle of cable on the spindle portion;

wherein the flange portion includes a first impact portion radially outward of a hub portion and a second impact portion radially outward of the first impact portion between the first impact portion and a perimeter wall of the flange portion;

wherein the first impact portion includes a circumferential arrangement of inner openings spaced apart in a circumferential direction;

wherein the second impact portion includes a circumferential arrangement of outer openings spaced apart in a circumferential direction;

wherein the flange portion include an impact transfer portion between a pair of adjacent ones of the outer openings;

wherein a radially outer wall of an outer opening of the plurality of outer openings is configured to deflect radially inward to absorb an impact force impacting the perimeter wall at a location radially outward of and radially aligned with the outer opening;

wherein the impact transfer portion between a pair of adjacent ones of the outer openings is configured to transfer an impact force impacting the perimeter wall at a location radially outward of and radially aligned with a space between the pair of adjacent ones of the plurality of outer openings to one of the inner openings radially aligned with the space, and a radially outer wall of the one of the inner openings is configured to deflect radially inward to absorb the impact force; and wherein the first and second impact portions are configured to provide absorption of impact forces impinging on any point along the perimeter wall so as to provide 360° of breakage protection against impact forces impinging on the perimeter wall.

9. The cable reel of claim 8, wherein the flange portion includes a first flange portion and a second flange portion that are identical to one another.

10. The cable reel of claim 9, wherein the first flange portion and the second flange portion are configured to be aligned with one another in a first direction.

11. The cable reel of claim 9, wherein the first flange portion and the second flange portion are configured to rotate together when cable is being paid out from a reel-less bundle of cable mounted on the spindle portion.

12. The cable reel of claim 8, wherein the inner openings comprise oblong openings, and wherein the outer openings comprise oblong openings.

13. The cable reel of claim 8, further comprising a strengthening portion structurally configured to prevent radially inward deflection of radially inner walls of the inner openings in response to an impact force against the perimeter wall.

14. The cable reel of claim 8, further comprising a strengthening portion structurally configured to prevent radially inward deflection of radially inner walls of the outer openings in response to an impact force against the perimeter wall.

15. The cable reel of claim 8, wherein a radially outer wall of one of the outer openings and a radially outer wall of one of the inner openings are configured to deflect radially inward to absorb an impact force that impinges on the perimeter wall at a location where the one of the outer openings overlaps the one of the inner openings.

16. A cable reel configured to absorb forces impacting a perimeter wall of the reel to prevent breakage, comprising:

a first reel portion configured to hold a bundle of cable;

a second reel portion configured to be coupled with the first reel portion and to retain the bundle of cable on the first reel portion;

wherein the second reel portion includes a first impact portion radially outward of a hub portion and a second impact portion radially outward of the first impact portion between the first impact portion and a perimeter wall of the second reel portion;

wherein the second impact portion includes a radially outer wall that is configured to deflect radially inward to absorb an impact force impacting the perimeter wall at a location radially aligned with the second impact portion;

wherein the first impact portion includes a radially outer wall that is configured to deflect radially inward to absorb an impact force impacting the perimeter wall at a location circumferentially spaced from the radially outer wall of the second impact portion; and wherein the first and second impact portions are configured to provide absorption of impact forces impinging on any point along the perimeter wall so as to provide 360° of breakage protection against impact forces impinging on the perimeter wall.

17. The cable reel of claim 16, wherein the second reel portion includes a first flange portion and a second flange portion that are identical to one another.

18. The cable reel of claim 17, wherein the first flange portion and the second flange portion are configured to be aligned with one another in a first direction.

19. The cable reel of claim 17, wherein the first flange portion and the second flange portion are configured to rotate together when cable is being paid out from a reel-less bundle of cable mounted on the first reel portion.

20. The cable reel of claim 16, wherein the first impact portion includes a circumferential arrangement of inner openings spaced apart in a circumferential direction;

wherein the second impact portion includes a circumferential arrangement of outer openings spaced apart in a circumferential direction;

wherein the second reel portion includes an impact transfer portion between each pair of adjacent ones of the outer openings;

wherein a radially outer wall of each outer opening is configured to deflect radially inward to absorb an impact force impacting the perimeter wall at a location where the outer opening does not overlap one of the inner openings; and wherein the impact transfer portion between adjacent ones of the outer openings is configured to transfer an impact force impacting the perimeter wall at a location where one of the inner openings is not overlapped by one of the outer openings to the one of the inner openings.

21. The cable reel of claim 20, wherein the inner openings comprise oblong openings, and wherein the outer openings comprise oblong openings.

22. The cable reel of claim 20, further comprising a strengthening portion structurally configured to prevent radially inward deflection of radially inner walls of the inner openings in response to an impact force against the perimeter wall.

23. The cable reel of claim 20, further comprising a strengthening portion structurally configured to prevent radially inward deflection of radially inner walls of the outer openings in response to an impact force against the perimeter wall.

24. The cable reel of claim 20, wherein a radially outer wall of one of the outer openings and a radially outer wall of one of the inner openings are configured to deflect radially inward to absorb an impact force that impinges on the perimeter wall at a location where the one of the outer openings overlaps one of the inner openings.

* * * * *